US010514045B2

(12) United States Patent
Yagi et al.

(10) Patent No.: US 10,514,045 B2
(45) Date of Patent: Dec. 24, 2019

(54) IMPELLER, ROTATING MACHINE, AND METHOD FOR ASSEMBLING ROTATING MACHINE

(71) Applicant: MITSUBISHI HEAVY INDUSTRIES COMPRESSOR CORPORATION, Tokyo (JP)

(72) Inventors: Nobuyori Yagi, Tokyo (JP); Daisuke Hirata, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 1140 days.

(21) Appl. No.: 14/774,248

(22) PCT Filed: Jan. 14, 2014

(86) PCT No.: PCT/JP2014/050444
§ 371 (c)(1),
(2) Date: Sep. 10, 2015

(87) PCT Pub. No.: WO2014/196214
PCT Pub. Date: Dec. 11, 2014

(65) Prior Publication Data

US 2016/0040687 A1 Feb. 11, 2016

(30) Foreign Application Priority Data

Jun. 4, 2013 (JP) ..... 2013-117596

(51) Int. Cl.
*F04D 29/62* (2006.01)
*F04D 29/28* (2006.01)
(Continued)

(52) U.S. Cl.
CPC ..... *F04D 29/626* (2013.01); *F04D 29/053* (2013.01); *F04D 29/284* (2013.01); *F04D 17/10* (2013.01)

(58) Field of Classification Search
CPC ..... F04D 17/10; F04D 29/023; F04D 29/053; F04D 29/266; F04D 29/284;
(Continued)

(56) References Cited

U.S. PATENT DOCUMENTS 5,163,816 A * 11/1992 Goetzke ..... F01D 5/025 416/204 A
5,464,325 A 11/1995 Albring et al.

FOREIGN PATENT DOCUMENTS

CN 101042145 A 9/2007
EP 0 635 643 A2 1/1995
(Continued)

OTHER PUBLICATIONS

English Translation of JP2006214341A, translated by Espacenet on May 30, 2019.*
(Continued)

*Primary Examiner* — Mark A Laurenzi
*Assistant Examiner* — Paul W Thiede
(74) *Attorney, Agent, or Firm* — Birch, Stewart, Kolasch & Birch, LLP

(57) ABSTRACT

An impeller is equipped with: a disk part, having a cylindrical part into which a rotary shaft that rotates around an axis line is inserted, with a portion of the cylindrical part in the axis line direction of the rotary shaft being fixed to the rotary shaft as a grip part, and a disk main body part extending from the cylindrical part outward in the radial direction of the rotary shaft a blade part protruding from the disk main body part toward a side in a first direction in the axis line direction; a reinforcing member attachment part
(Continued)

formed on the cylindrical part closer to a side in a second direction in the axis line direction than the disk main body part; and a reinforcing member formed of material having a higher specific strength than the disk part, and attached so as to cover the reinforcing member attachment part from the outside.

7 Claims, 15 Drawing Sheets

(51) Int. Cl.
*F04D 29/053* (2006.01)
*F04D 17/10* (2006.01)

(58) Field of Classification Search
CPC .... F04D 29/624; F04D 29/626; F04D 29/043; F04D 29/28; F05D 2300/171; F05D 2300/174; F05D 2300/43; F05D 2300/603; F01D 5/025
USPC ..... 416/223 R, 204 A
See application file for complete search history.

(56) References Cited

FOREIGN PATENT DOCUMENTS

| | | | |
|---|---|---|---|
| JP | 7-63193 | A | 3/1995 |
| JP | 08-232889 | A | 9/1996 |
| JP | 3129587 | B | 1/2001 |
| JP | 2005-002849 | A | 1/2005 |
| JP | 2006-214341 | A | 8/2006 |
| JP | 2009-167882 | A | 7/2009 |
| JP | 2009-264205 | A | 11/2009 |
| JP | 2011-085088 | A | 4/2011 |
| JP | 2012-122398 | A | 6/2012 |
| JP | 2013-513749 | A | 4/2013 |
| WO | WO 2011/069991 | A2 | 6/2011 |
| WO | WO 2012/077422 | A1 | 6/2012 |

OTHER PUBLICATIONS

International Search Report dated Apr. 22, 2014 in counterpart PCT Application No. PCT/JP2014/050444 with an English translation.
Written Opinion dated Apr. 22, 2014 in counterpart PCT Application No. PCT/JP2014/050444 with an English translation.
Chinese First Office Action and Search Report for Chinese Application No. 201480013679.6, dated Aug. 19, 2016, with partial English translation.
Japanese Notice of Allowance for Japanese Application No. 2013-117596, dated Sep. 20, 2016, with English translation.
Office Action dated Mar. 1, 2016 in Counterpart Application No. JP 2013-117596 with an English Translation.
Extended European Search Report dated Jan. 28, 2016 in counterpart European Application No. 14807357.0.

* cited by examiner

IMPELLER, ROTATING MACHINE, AND METHOD FOR ASSEMBLING ROTATING MACHINE

TECHNICAL FIELD

The present invention relates an impeller, a rotating machine in which the impeller is fixed to a rotary shaft, and a method for assembling the rotating machine.

Priority is claimed on Japanese Patent Application No. 2013-117596, filed Jun. 4, 2013, the content of which is incorporated herein by reference.

BACKGROUND ART

In a turbo refrigerator, a small gas turbine, or the like, a rotating machine such as a centrifugal compressor is provided. The centrifugal compressor includes an impeller in which a plurality of blades are provided on a disk part fixed to a rotary shaft. In the centrifugal compressor, pressure energy and speed energy are applied to the gas by rotating the impeller.

For example, when a light fluid such as hydrogen is compressed, or when a higher supercharging pressure is required, or the like, it is necessary to rotate the impeller of the centrifugal compressor at a high speed. More specifically, for example, when hydrogen is compressed, like a case where the number of rotations of the impeller increases from several thousands rpm to several tens of thousands rpm, it is necessary to rotate the impeller at a high speed. Particularly, in a centrifugal compressor in which a rotary shaft is inserted into an attachment hole formed in a center portion in a radial direction of the impeller and the entire inner peripheral surface of the attachment hole is gripped by the rotary shaft, when the impeller is rotated at a high speed, tensile stress in the vicinity of the inner peripheral surface of the attachment hole increases, and thus, the attachment hole may be damaged.

Accordingly, in order to prevent the tensile stress in the vicinity of the inner peripheral surface from increasing, it is suggested that a stress reduction depression is formed on the inner peripheral surface of the attachment hole (for example, refer to PTL 1).

CITATION LIST

Patent Literature

[PTL 1] Japanese Unexamined Patent Application Publication No. 2005-002849

SUMMARY OF INVENTION

Technical Problem

In order to easily perform attachment and detachment of the impeller with respect to the rotary shaft, improve maintenance, or the like, a grip part which is fixed to the rotary shaft is provided on the front side of a cylinder part.

FIG. 12 is a contour diagram showing a simulation result of stress which acts on an impeller 610 having a grip part 33 on the front side of the impeller when the impeller rotates at a high speed. The impeller 610 is a so-called open type impeller which includes a disk part 30 and a blade part 40. As shown in FIG. 13, the disk part includes a cylindrical part 32 in which a grip part (the left portion in FIG. 13) 33 positioned on a front side in an axis line O direction of a rotary shaft 5 is fixed to the rotary shaft 5 using shrinkage fitting or the like, and a disk main body part 35 which is provided further rearward in the axis line O direction than the grip part 33 and extends outward in a radial direction of the rotary shaft 5.

In the impeller 610 formed as described above, a location (a location at which stress is concentrated), at which stress generated when the rotary shaft 5 rotates at a high speed becomes the maximum, is the vicinity of a corner portion on the rear side in the axis line O direction on the side opposite to the grip part 33. This is because the corner portion of the disk part 30 is to be displaced outward in the radial direction as shown by a dashed line in FIG. 13 due to a centrifugal force generated during rotation, a load in a thrust direction (a thrust force) generated by a difference of a gas pressure between a flow path side and a disk rear surface side, or the like. The stress concentration in the vicinity of the corner portion is mainly generated by hoop stress which is the tensile stress acting in a circumferential direction of the impeller 610. In FIG. 13, the location at which the hoop stress is concentrated is shown by a reference numeral "f".

The magnitude of the hoop stress in the vicinity of the corner portion of the disk part 30 increases as the rotating speed increases. Accordingly, for example, when the rotating speed unintentionally increases, the strength of the disk part 30 may be insufficient. In order to prevent insufficiency of the strength, a method is considered, in which the cylindrical part 32 is fixed to the outer peripheral surface of the rotary shaft 5 over the entire surface in the inner periphery of the cylindrical part 32. In addition, as disclosed in PTL 1, the method is also considered, in which the cylindrical part 32 is fixed to the outer peripheral surface of the rotary shaft 5 at the plurality of locations. However, when the impeller 610 is removed from the rotary shaft 5 or the like, it is necessary to increase the temperature of the disk part 30 over a wide range of the disk part 30, and thus, ease of assembly or maintenance deteriorates. In addition, as described above, the tensile stress increases.

Meanwhile, in order to decrease the hoop stress in the vicinity of the corner portion of the disk part 30 without decreasing the ease of assembly and the maintenance, for example, as an impeller 710 shown in FIG. 14, it is considered that a thickness on a rear surface side of the disk part 30 is increased. FIG. 15 is a contour diagram showing a simulation result when the thickness on the rear surface side of the disk part 30 increases. As shown in FIG. 15, the thickness of the rear surface side of the disk part 30 increases and the stress is uniform, and thus, the magnitude of the hoop stress decreases as a whole further than that of the above-described case shown in FIG. 12

However, as shown in FIG. 16, when the grip part 33 is provided on the front side in the axis line O direction, bend-back occurs in the center portion in the axis line O direction as shown by a dashed line of FIG. 16, and it may not be possible to sufficiently decrease the stress. In addition, the weight of the impeller 610 increases, the span of the impeller 610 in the axis line O direction increases, and thus, shaft vibration increases, and it may not be possible to rotate the impeller 610 at a high speed.

The present invention provides an impeller which can be easily attached to and detached from a rotary shaft, can sufficiently decrease stress during rotation, and can be rotated at a high speed, a rotating machine having the impeller, and a method for assembling the rotating machine.

Solution to Problem

According to a first aspect of the present invention, there is provided an impeller including: a disk part which includes a cylindrical part into which a rotary shaft rotating around an axis line is inserted and in which a portion in the axis line direction of the rotary shaft is fixed to the rotary shaft as a grip part, and a disk main body part which extends from the cylindrical part outward in a radial direction of the rotary shaft; a blade which protrudes from the disk main body part toward a side in a first direction in the axis line direction; a reinforcing member attachment part which is formed on the cylindrical part closer to a side in a second direction in the axis line direction than the disk main body part; and a reinforcing member which is formed of a material having a higher specific strength than the disk part, and is attached so as to cover the reinforcing member attachment part from the outside.

In the impeller of a second aspect of the present invention, according to the impeller of the first aspect, the reinforcing member attachment part may include: an attachment part main body which is integrally formed with the cylindrical part; and a ring member which is formed of a material having a linear expansion coefficient equal to or greater than the linear expansion coefficient of the attachment part main body, and is attached to the attachment part main body, and the reinforcing member may be attached to the ring member.

In the impeller of a third aspect of the present invention, according to the impeller of the first or second aspect, the grip part may be disposed so as to be closer to the side in the second direction in the axial line direction than the reinforcing member, and the impeller may includes a grip reinforcing member which is attached at the position of the cylindrical part at which the grip part is disposed and reinforces the grip part.

In the impeller of a fourth aspect, according to the impeller of any one of the first to third aspects, a ratio of a diameter of the reinforcing member with respect to a diameter of the disk main body part may be 0.35 to 0.8.

According to a fifth aspect of the present invention, a rotating member includes the impeller according to any one of the first to fourth aspects.

According to a sixth aspect, a method for assembling a rotating machine is a method for assembling a rotating machine which includes the impeller according to the first aspect, the method including an attachment step of attaching the reinforcing member to the reinforcing member attachment part; and an impeller attachment step of attaching the impeller to the rotary shaft.

According to a seventh aspect, a method for assembling a rotating machine is a method for assembling a rotating machine which includes the impeller according to the second aspect, the method including a reinforcing member attachment step of attaching the reinforcing member to the ring member; a ring member attachment step of attaching the ring member, to which the reinforcing member is attached, to the attachment part main body; and an impeller attachment step of attaching the impeller to the rotary shaft.

Advantageous Effects of Invention

According to the present invention, an impeller can be easily attached to and detached from a rotary shaft, it is possible to sufficiently decrease hoop stress during rotation, and it is possible to rotate the impeller at a high speed.

DESCRIPTION OF EMBODIMENTS

Next, a rotating machine and an impeller in a first embodiment of the present invention will be described with reference to the drawings.

Figure 1:
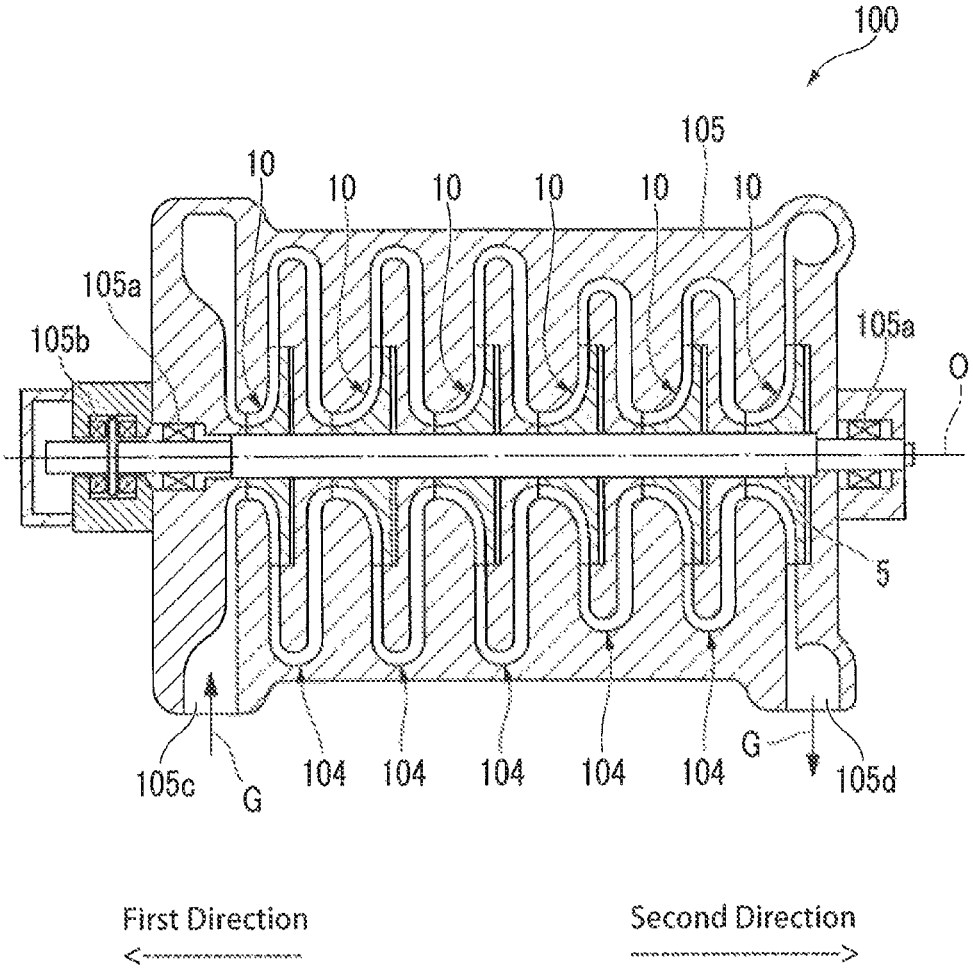
FIG. 1 is a longitudinal sectional view of a centrifugal compressor in an embodiment of the present invention.

FIG. 1 is a configuration view showing a schematic configuration of a centrifugal compressor 100 which is a rotating machine of a first embodiment.

As shown in FIG. 1, a rotary shaft 5 is rotatably supported by a casing 105 of the centrifugal compressor 100 via a journal bearing 105*a* and a thrust bearing 105*b*. The rotary shaft 5 can rotate around an axis line O. A plurality of impellers 10 are attached to rotary shaft 5 so as to be arranged in the axis line O direction. Each impeller 10 gradually compresses gas G supplied from an upstream flow path 104 formed in the casing 105 to a downstream flow path 104 using a centrifugal force generated due to rotation of the rotary shaft 5, and causes the gas G to flows toward the downstream flow path 104.

In the casing 105, a suction port 105*c* for sucking the gas G from the outside is formed on the front side (the left side in FIG. 1) in the axis line O direction of the rotary shaft 5. In the casing 105, a discharging port 105*d* for discharging the gas G to the outside is formed on the rear side (the right side in FIG. 1) in the axis line O direction. In descriptions below, the left side on a paper surface is referred to as the "front side", and the right side on the paper surface is referred to as the "rear side".

According to the centrifugal compressor 100, when the rotary shaft 5 rotates, the gas G flows from the suction port 105*c* into the flow path 104, and the gas G is gradually compressed by the impellers 10 and is discharged from the discharging port 105*d*. Here, FIG. 1 shows an example in which six impellers 10 are provided on the rotary shaft 5 in series. However, at least one impeller 10 may be provided on the rotary shaft 5. In descriptions below, for easy explanation, an example in which one impeller 10 is provided on the rotary shaft 5 is described.

Figure 2:
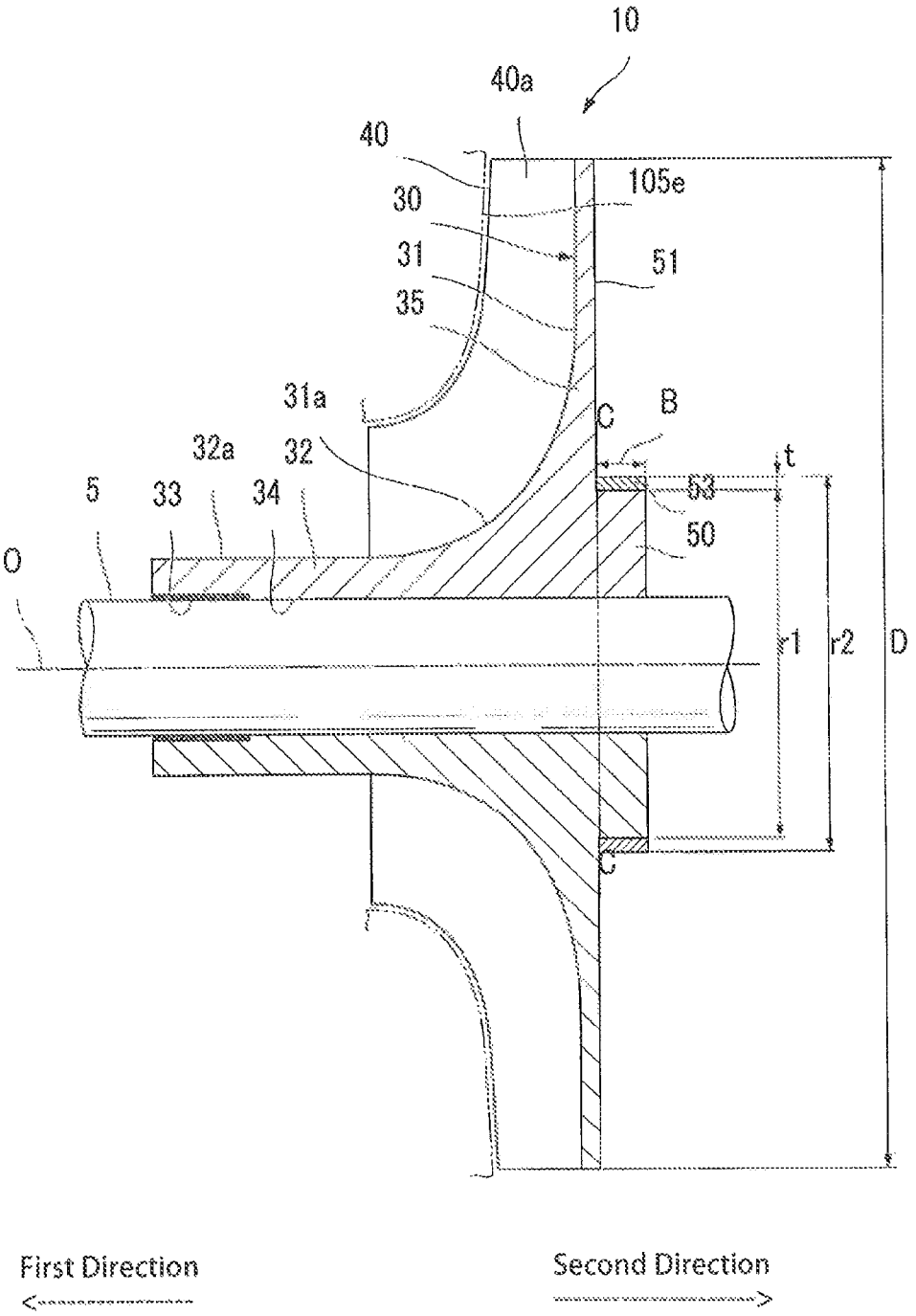
FIG. 2 is a longitudinal sectional view of an impeller in a first embodiment of the present invention.

As shown in FIG. 2, the impeller 10 includes a disk part 30 which is fixed to the rotary shaft 5, and a plurality of blade parts 40 which is provided to protrude from a front surface 31 in the axis line O direction of the disk part 30. The impeller 10 is a so-called open type impeller.

The disk part 30 includes a cylindrical part 32 which is fixed to the rotary shaft 5 by fitting. The cylindrical part 32 includes a grip part 33 and a non-grip part 34.

The grip part 33 is provided on a front side which is a side in a first direction in the axis line O direction. The grip part 33 is fixed to the outer peripheral surface of the rotary shaft 5.

The non-grip part 34 is provided on a rear side, which is a side in a second direction in the axis line O direction and is positioned further rearward than the grip part 33. The non-grip part 34 is formed so as to have a diameter which is slightly greater than an outer diameter of the rotary shaft 5, and thus, a gap is formed between the non-grip part 34 and the outer peripheral surface of the rotary shaft 5. That is, a portion in the axis direction O direction of the disk part 30 is fixed to the rotary shaft as the grip part 33. The grip part 33 is formed so that the grip part 33 has a smaller diameter than the diameter of the rotary shaft 5 in a state where the grip part 33 is not fixed to the rotary shaft 5. The grip part 33 is fixed to the rotary shaft 5 by fitting such as shrinkage fitting or the like.

The disk part 30 includes a disk main body part 35 which is positioned further rearward in the axis direction O direction than the grip part 33. The disk main body part 35 is formed in a disk shape which extends from the non-grip part 34 of the cylindrical part 32 outward in the radial direction. The disk main body part 35 is formed so that the thickness gradually increases inward in the radial direction.

The disk part 30 includes a concave curved surface 31*a* which smoothly connects the front surface 31 and an outer peripheral surface 32*a* of the cylindrical part 32.

The blade part 40 protrudes from the front surface 31 of the disk part 30 toward the front side in the axis line O direction. The blade part 40 has a constant plate thickness. The blade part 40 is formed so as to be slightly thinned outward in the radial direction in a side view. In addition, the plurality of blade parts 40 are arranged while leaving a predetermined gap therebetween in the circumferential direction of the disk main body part 35. Here, the above-described flow path 104 is formed by the front surface 31 of the impeller 10, the curved surface 31*a*, the outer peripheral surface 32*a*, surfaces 40*a* of the blade part 40 opposing each other in the circumferential direction, and a wall surface 105*e* of the casing 105 opposing the front surface 31 and the curved surface 31*a*, in the location at which the impeller 10 is disposed.

The above-described disk part 30 includes a cylindrical reinforcing member attachment part 50 which is positioned further rearward in the axis direction O direction than the disk main body part 35 and configures a portion of the cylindrical part 32. The reinforcing member attachment part 50 is formed so as to have the outer diameter which is larger than the outer diameter of the cylindrical part 32 in the above-described grip part 33. In FIG. 2, the rearmost position in the axis line O direction on a base portion side of the disk main body part 35 is shown by line C-C. A portion, which is formed further rearward in the axis direction O direction than line C-C, becomes the reinforcing member attachment part 50.

A reinforcing member 53 is attached to the reinforcing member attachment part 50 so as to cover the outside of the reinforcing member attachment part 50.

Figure 3:
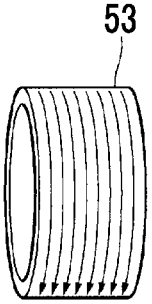
FIG. 3 is a perspective view of a reinforcing member in the first embodiment of the present invention.

As shown in FIGS. 2 and 3, the reinforcing member 53 regulates deformation of the reinforcing member attachment part 50 toward the outside in the radial direction. The reinforcing member 53 is formed in a cylindrical shape having an inner diameter which is slightly smaller than the outer diameter of the reinforcing member attachment part 50. The reinforcing member 53 is configured of a material having a higher specific strength than the disk part 30. In addition, the reinforcing member 53 is attached to the reinforcing member attachment part 50 in a state where one end surface of the reinforcing member 53 comes into contact with a rear surface 51. Here, the specific strength indicates yield strength/density. Specific rigidity of a material which forms the reinforcing member 53 is higher than specific rigidity of a material which forms the disk part 30.

For example, the above-described impeller 10 is formed of alloy such as stainless steel or titanium alloy. Meanwhile, materials configuring the reinforcing member 53 may include carbon fiber reinforced plastic (hereinafter, simply referred to as CFRP), ceramic, magnesium alloy, or the like having higher specific strength than that of the material which forms the impeller 10 such as stainless steel or titanium alloy. In addition, preferably, CFRP, the ceramic, magnesium alloy, or the like having higher specific rigidity than that of the alloy such as stainless steel or titanium alloy is used. For example, when the carbon fiber reinforced plastic is used for the reinforcing member 53, as shown by arrows in FIG. 3, carbon fibers used as reinforcing materials includes carbon fibers which extend in the circumferential direction so as to be wound around at least the reinforcing member attachment part 50. In this way, since the carbon fibers extend in the circumferential direction, deformation in the radial direction does not easily occur.

Preferably, the material of the reinforcing member 53 has 1 to 2.5 times Young's modulus with respect to Young's modulus of the alloy which is the material of the impeller 10. For example, Young's modulus of titanium alloy is approximately 113 GPa. Since Young's modulus of the reinforcing member 53 is set as described above, it is possible to prevent the reinforcing member attachment part 50 from being deformed outward in the radial direction due to hoop stress generated by a centrifugal force during rotation, using the reinforcing member 53 having higher Young's modulus than that of the reinforcing member attachment part 50.

From the viewpoint of a decrease in weight of the reinforcing member 53, preferably, the reinforcing member 53 is set according to the maximum value (the maximum value of the hoop stress acting on the impeller 10) of the number of rotations in the rotary shaft 5, the minimum length B, and a thickness t. The maximum value of the hoop stress acting on the impeller 10 decreases as the thickness t of the reinforcing member 53 increases. Here, when the diameter of the impeller 10 is defined as "D", in order to prevent the increase in the weight of the reinforcing member 53 as much as possible, preferably, the thickness "t" of the reinforcing member 53 satisfies t/D=0.015 to 0.06. In addition, in order to suppress a span in the axis line O direction of the impeller 10, preferably, a width "B" of the reinforcing member 53 satisfies B/D=0.01 to 0.03. However, the width may satisfy B/D>0.03.

A ratio of a diameter r2 of the reinforcing member 53 with respect to the diameter D of the disk main body part 35 is 0.35 to 0.8. More preferably, the ratio is 0.42 to 0.66. As described above, an outer diameter r1 of the reinforcing member attachment part 50 is only slightly greater than the inner diameter of the reinforcing member 53, and thus, the diameter r2 of the reinforcing member 53 is the same value as (r1+2t).

FIGS. 4A to 4D show examples in which the diameter r2 of the reinforcing member 53 is changed within the range of the diameter D of the disk main body part 35. In addition, FIG. 5 is a graph showing a change in the magnitude of local stress (the maximum stress of the disk) in the impeller 10 when a rate (attachment position (diameter) of the reinforcing member r2/disk diameter D) of the inner diameter of the reinforcing member 53 with respect to the diameter of the disk main body part 35 is changed. In the graph of FIG. 5, "a1" indicates an upper limit of allowable stress in the impeller 10, and "a2" indicates an upper limit of more appropriate stress in the impeller 10.

Figure 4A:
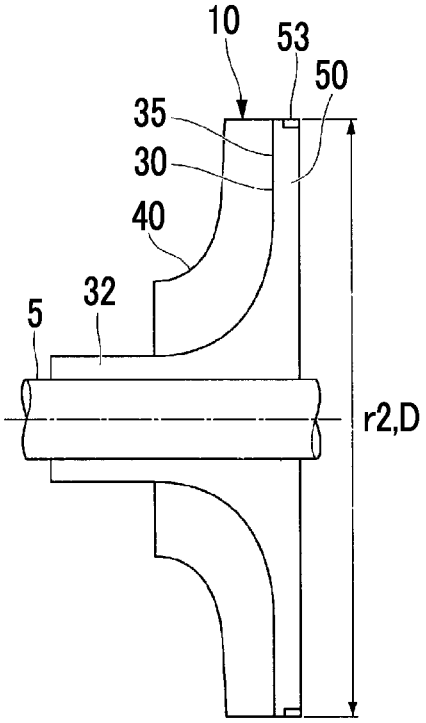
FIG. 4A is an explanatory view when an attachment position of the reinforcing member satisfies r2/D=1.0.
Figure 5:
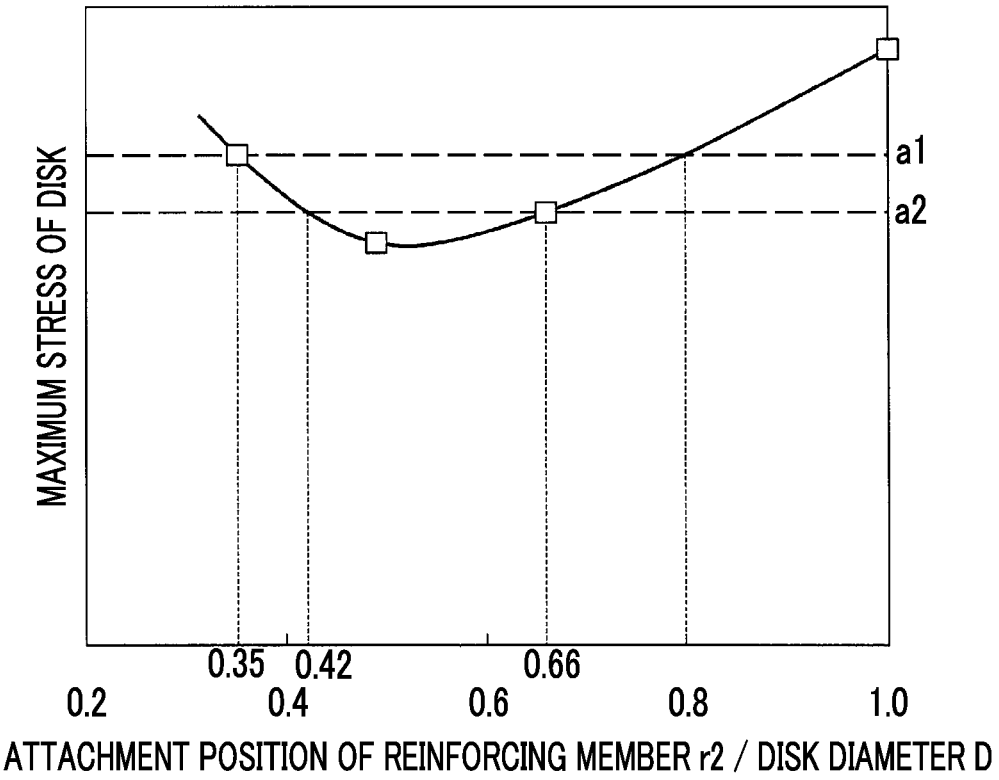
FIG. 5 is a graph showing a maximum stress of a disk part with respect to r2/D.

FIG. 4A shows the case of r2/D=1. That is, the reinforcing member 53 is attached to the disk main body part 35 at substantially the same position as the tip portion of the disk main body part 35. As shown in FIG. 5, in the case of FIG. 4A, stress which is higher than the upper limit a1 occurs. It is considered that this is because the mass of the impeller 10 inside the reinforcing member 53 increases and it is not possible to sufficiently prevent the deformation generated by the centrifugal force of the reinforcing member attachment part 50, using the reinforcing member 53.

Figure 4B:
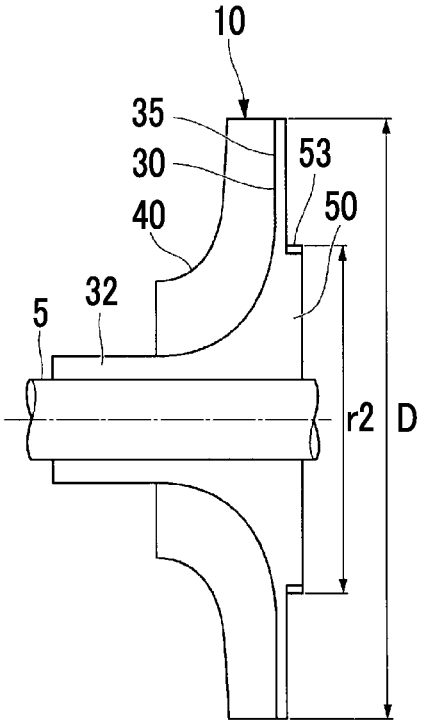
FIG. 4B is an explanatory view when the attachment position of the reinforcing member satisfies r2/D=0.66.
Figure 4C:
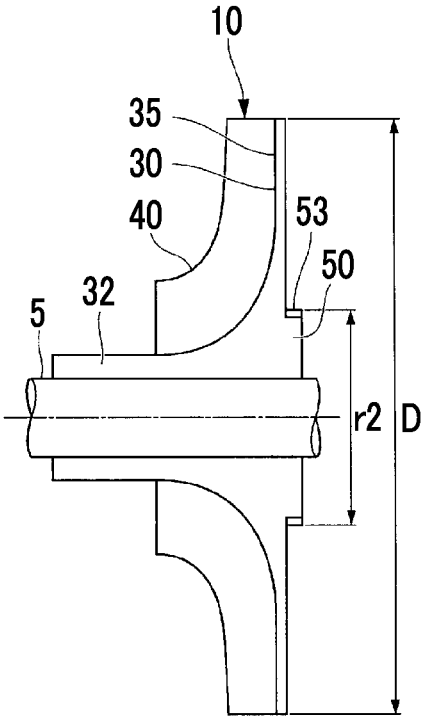
FIG. 4C is an explanatory view when the attachment position of the reinforcing member satisfies r2/D=0.49.

FIGS. 4B and 4C show the cases of r2/D=0.66 and r2/D=0.49. In the cases of FIGS. 4B and 4C, the stress applied to the impeller 10 is decreased so as to be stress which is lower than the upper limit a1 and the upper limit a2.

Figure 4D:
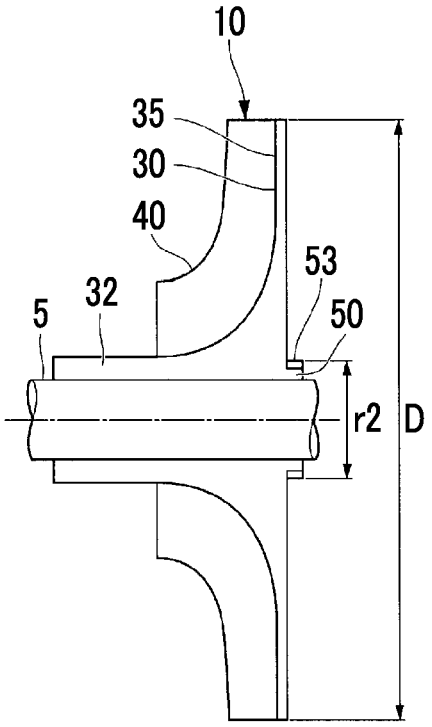
FIG. 4D is an explanatory view when the attachment position of the reinforcing member satisfies r2/D=0.35.

Meanwhile, FIG. 4D shows the case of r2/D=0.35. As shown in FIG. 5, in the case of FIG. 4D, the stress of the impeller 10 is higher than the upper limit a2 and is the same value as the upper limit a1. It is considered that this is because the outer diameter r1 of the reinforcing member attachment part 50 is decreased too much, the strength of the reinforcing member attachment part 50 is not sufficient, a connection portion between the reinforcing member attachment part 50 and the disk main body part 35 is deformed, and thus, the hoop stress increases at the deformed location.

That is, preferably, the ratio of the diameter of the reinforcing member 53 with respect to the diameter of the disk main body part 35 is 0.42 to 0.66 in which the stress applied to the impeller 10 is less than the upper limit a1. In addition, more preferably, the ratio is 0.35 to 0.8 in which the stress applied to the impeller 10 is less than the upper limit a2.

Figure 6:
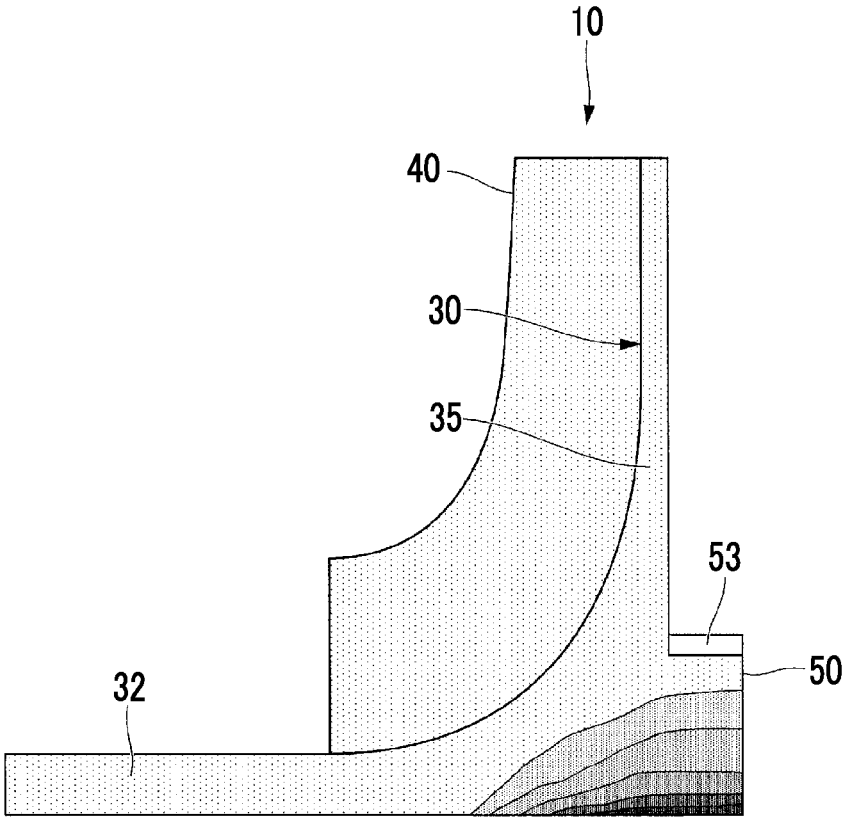
FIG. 6 is a view showing a simulation result of the impeller.

FIG. 6 is a contour diagram showing a simulation result of a stress distribution at high speed rotation in the impeller 10 of the embodiment. In addition, in FIG. 6, color is darkened as the stress applied to the location increases. Here, in general, the centrifugal force of the impeller 10 when the impeller 10 which does not include the reinforcing member 53 rotates becomes the maximum value at line C-C along the rear surface 51 of the disk main body part 35 or in the vicinity thereof. Accordingly, the hoop stress becomes the maximum stress at the location at which line C-C and the maximum inner diameter portion of the non-grip part 34 intersect each other, or in the vicinity thereof.

Figure 12:
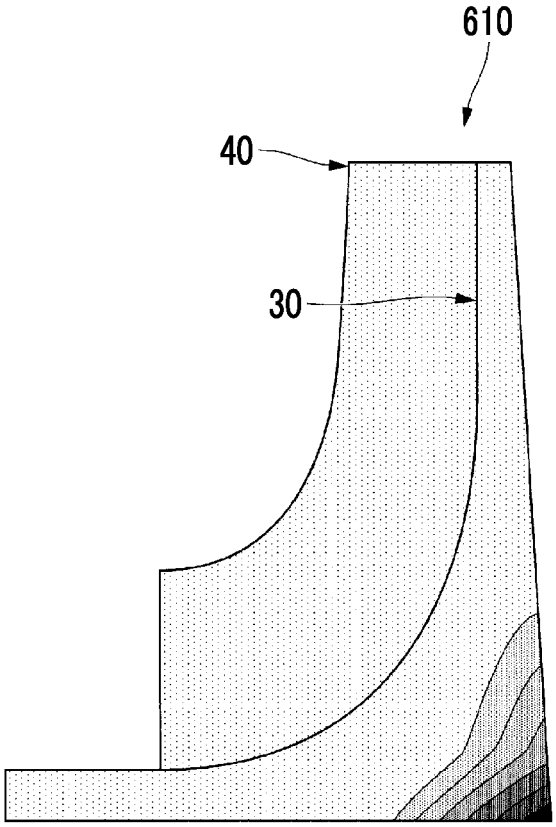
FIG. 12 is a view corresponding to FIG. 6 in a general impeller.
Figure 13:
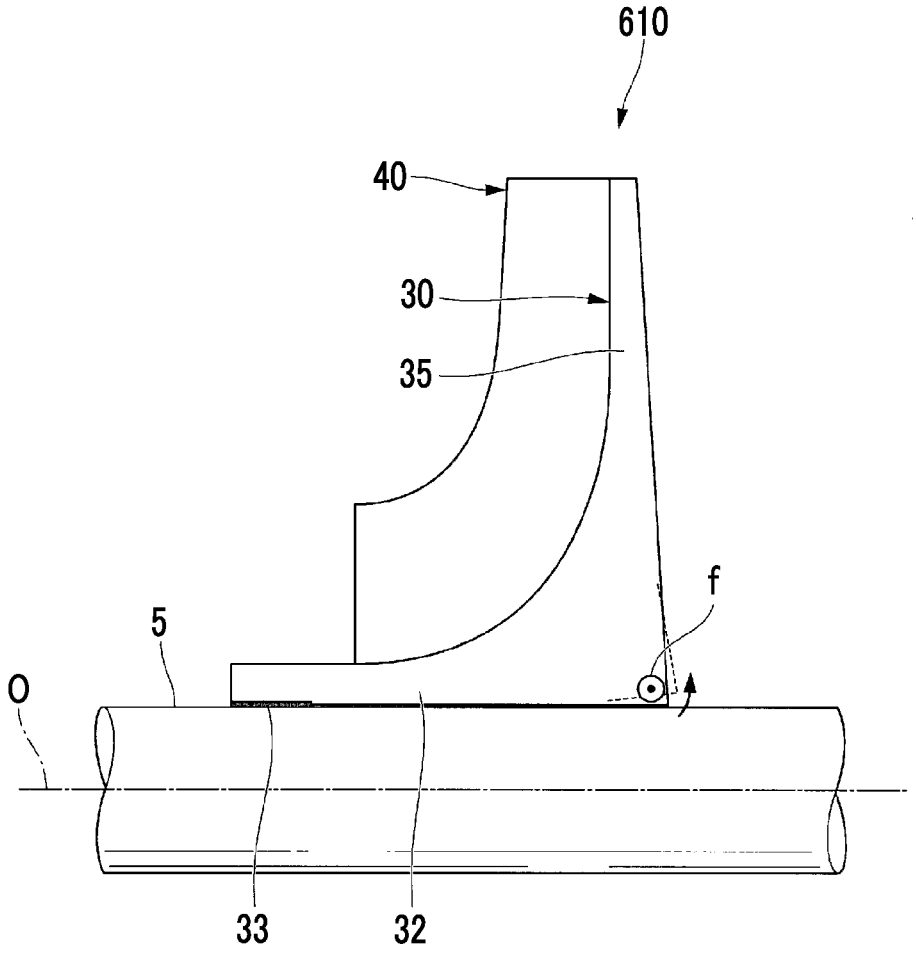
FIG. 13 is an explanatory view of hoop stress in the general impeller.

As shown in FIG. 6, in the case of the impeller 10 of the embodiment, a range within which the stress applied during the rotation increases further spread in the axial line O direction than the case of the impeller (for example, refer to FIG. 12) in which the reinforcing member 53 is not included. However, the maximum value decreases. This is because the rigidity of the cylindrical part 32 in the radial direction is increased due to the centrifugal force generated by the reinforcing member 53, and thus, the impeller 10 is prevented from being deformed to float outward in the radial direction on the side in the second direction in the axis line O direction. That is, in the impeller 10, the local increase of the hoop stress, which is generated when the impeller 10 is deformed in the radial direction, is prevented.

Figure 7A:
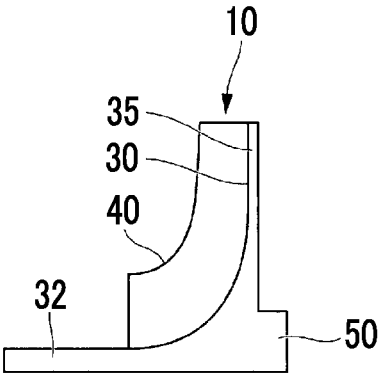
FIG. 7A is a view showing a state where the reinforcing member is not mounted in an attachment procedure of the impeller.
Figure 7B:
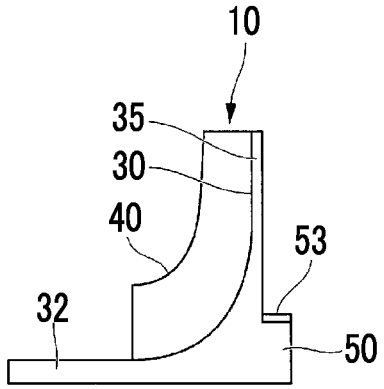
FIG. 7B is a view showing a state where the reinforcing member is mounted in the attachment procedure of the impeller.
Figure 7C:
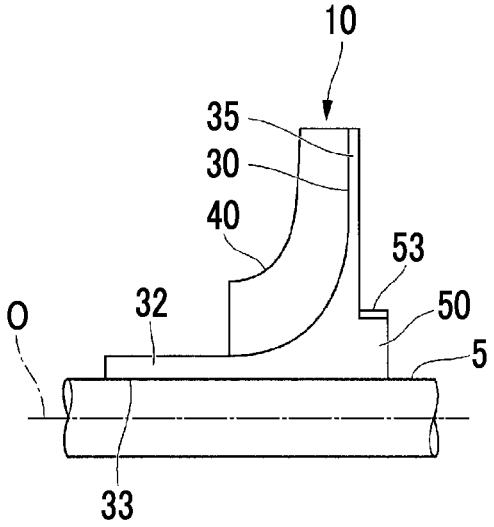
FIG. 7C is a view showing a state where the impeller is fixed to a rotary shaft in the attachment procedure of the impeller.

FIGS. 7A to 7C show a method for assembling the centrifugal compressor 100, and particularly, an example of a procedure in which the impeller 10 is attached to the rotary shaft 5.

First, as shown in FIGS. 7A and 7B, the reinforcing member 53 is attached to the reinforcing member attachment part 50 of the impeller 10 (attachment step). As a method for attaching the reinforcing member 53, freeze fitting, shrinkage fitting, or the like may be used. When the reinforcing member 53 is formed of CFRP and the reinforcing member 53 is attached to the reinforcing member attachment part 50 by shrinkage fitting, in order to decrease a thermal load to CFRP, for example, preferably, the shrinkage fitting is performed at 100° C. or less with loose interference. In addition, when the reinforcing member 53 is CFRP, the reinforcing member 53 may be attached to the reinforcing member attachment part 50 in a state where a predetermined tension is applied.

Subsequently, as shown in FIG. 7C, the impeller 10 is attached to the rotary shaft 5 using freeze fitting or shrinkage fitting (impeller attachment step). When the reinforcing member 53 is formed of CFRP and the impeller 10 is shrinkage-fitted to the rotary shaft 5, in order to decrease the thermal load to CFRP, preferably, the grip part 33 is locally heated so that the temperature of the reinforcing member 53 does not exceed 100° C.

Figure 14:
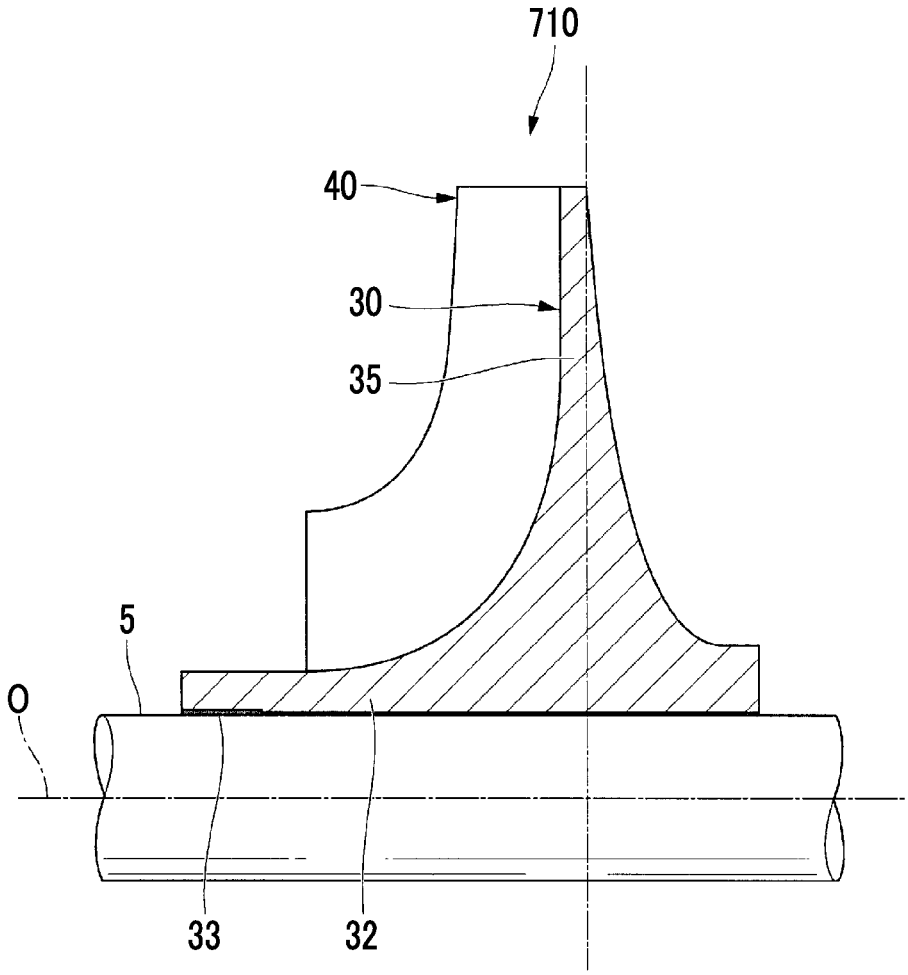
FIG. 14 is a longitudinal section view of an impeller in which a thickness on a rear surface side of a disk part of an impeller increases.
Figure 15:
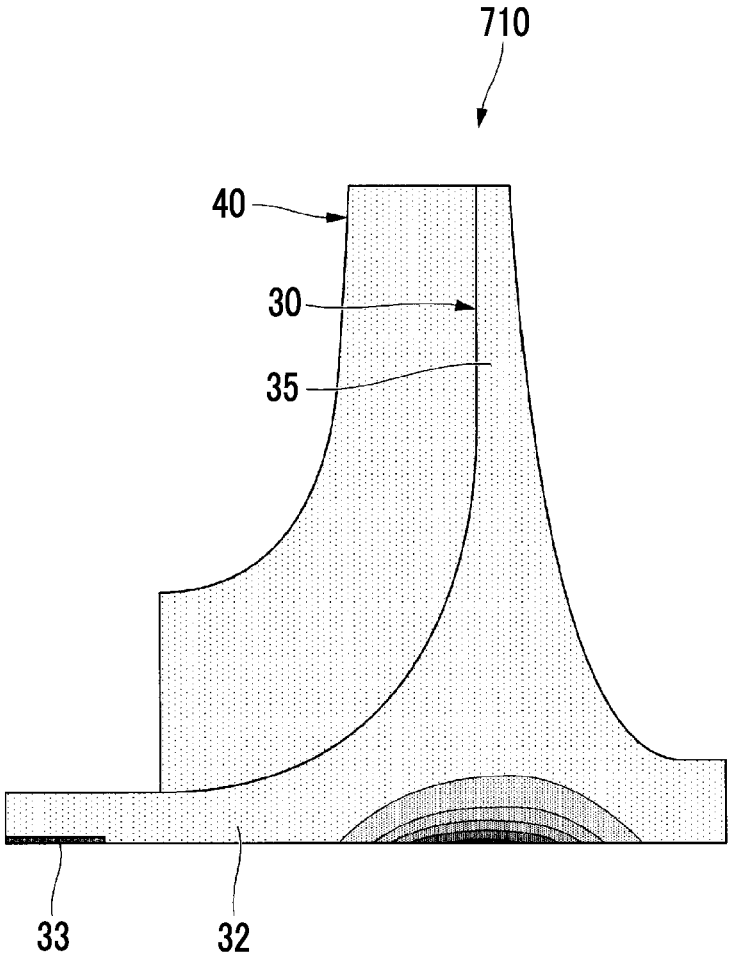
FIG. 15 is a view corresponding to FIG. 12 in the impeller in which the thickness on the rear surface side of the disk part of the impeller increases.
Figure 16:
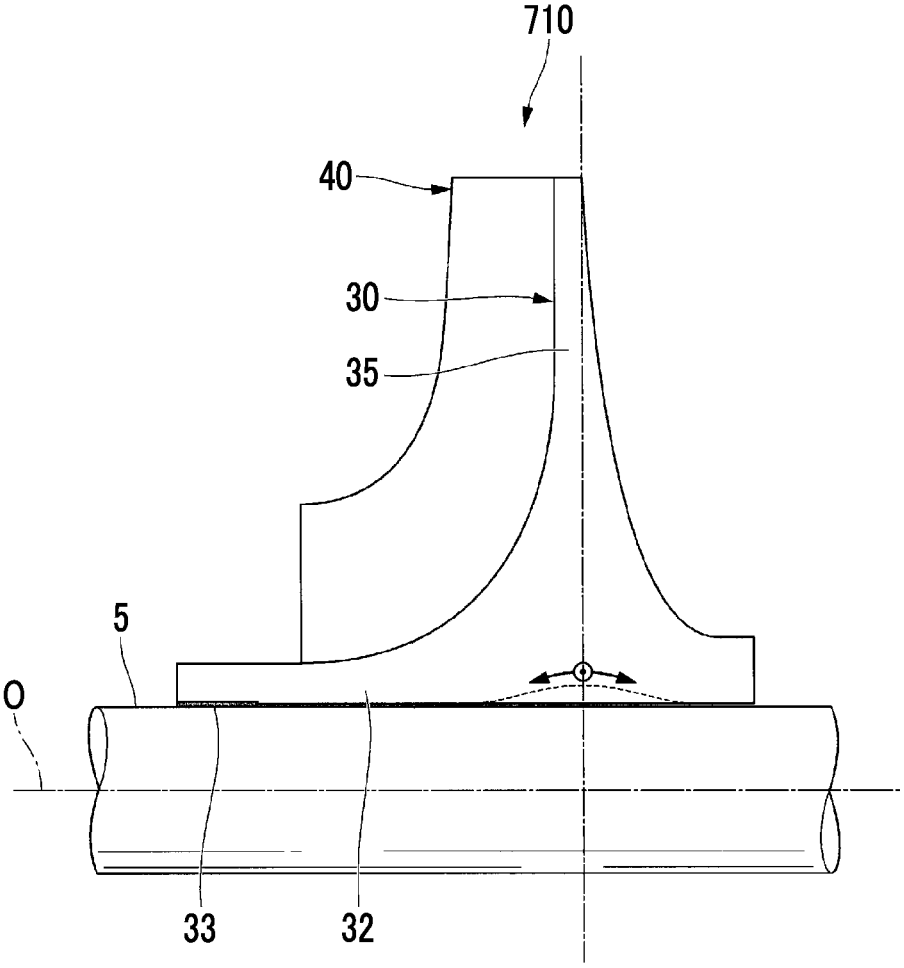
FIG. 16 is an explanatory view of the hoop stress and the tensile stress in the impeller in which the thickness on the rear surface side of the disk part of the impeller increases.

Therefore, according to the impeller 10 of the above-described first embodiment, the reinforcing member 53 formed of the material having a higher specific strength than the impeller 10 is attached to the reinforcing member attachment part 50 which is formed on the rearward cylindrical part 32 in the axis line O direction, and thus, it is possible to increase the rigidity of the cylindrical part 32 against the deformation of the cylindrical part 32 toward the outside in the radial direction due to the centrifugal force. Accordingly, it is possible to prevent the impeller 10 from being deformed to float in the radial direction on the rear side in the axis line O direction, and it is possible to prevent the hoop stress from increasing. Moreover, compared to when the thickness of the rear surface 51 of the disk main body part 35 increases as shown in FIG. 14, it is possible to decrease the length in the axis line O direction of the disk part 30, and it is possible to decrease the weight of the impeller 10 due to the decrease in the length in the axis line O direction.

As a result, the impeller 10 can be easily attached and detached from the rotary shaft 5, and it is possible to sufficiently decrease the stress during the rotation. In addition, since it is possible to decrease the span of the impeller 10 in the axis line O direction and to decrease the weight of the impeller 10, it is possible to prevent vibration of the shaft and to rotate the impeller 10 at a high speed. Moreover, since the grip part 33 is formed on only a portion on the front side in the axis line O direction, the impeller 10 can be easily attached to and detached from the rotary shaft 5. As a result, it is possible to improve maintenance.

In addition, when the ratio of the diameter r2 of the reinforcing member 53 with respect to the diameter D of the disk main body part 35 is greater than 0.8, the thickness of the cylindrical part 32 in the radial direction increases, the centrifugal force applied to the cylindrical part 32 increases, and thus, the size of the reinforcing member 53 increases. Meanwhile, when the ratio of the diameter r2 of the reinforcing member 53 with respect to the diameter D of the disk main body part 35 is less than 0.35, the thickness of the cylindrical part 32 is decreased too much, the strength of the cylindrical part 32 is not sufficient, and thus, the deformation of the cylindrical part 32 is not prevented. However, in the above-described embodiment, since the ratio of the diameter r2 of the reinforcing member 53 with respect to the diameter D of the disk main body part 35 is from 0.35 to 0.8, it is possible to effectively prevent the hoop stress generated due to the centrifugal force.

Next, an impeller 210 according to a second embodiment of the present invention will be described with reference to the drawings. A difference between the impeller 210 of the second embodiment and the impeller 10 of the first embodiment is that the configurations of the reinforcing member attachment parts are different from each other. Therefore, the same reference numerals are assigned to the same portions as the above-described first embodiment, and the detailed descriptions are omitted.

Figure 8:
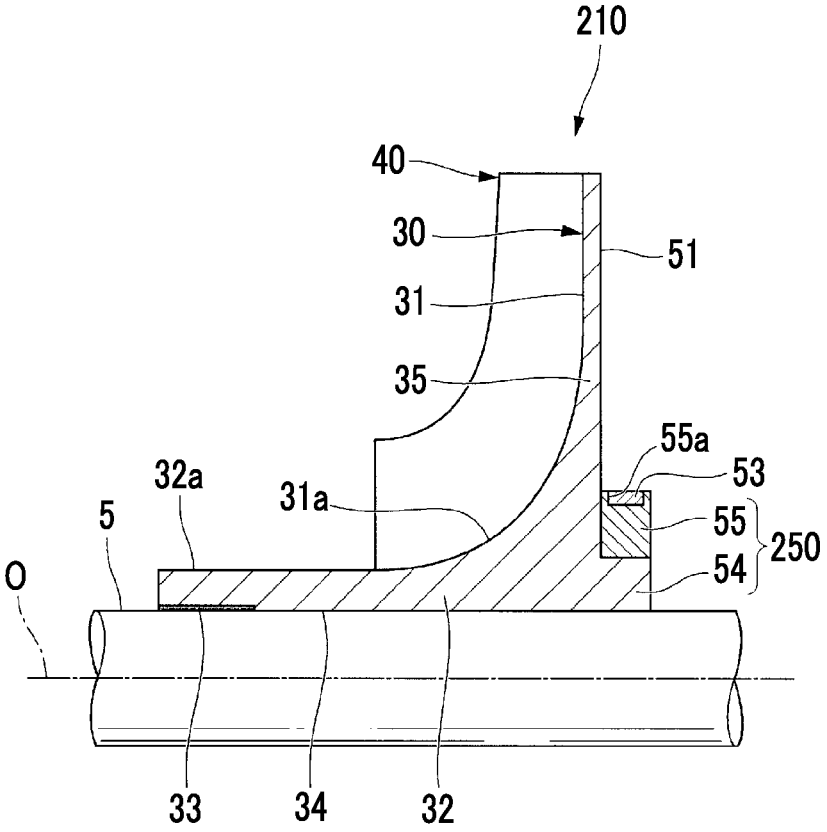
FIG. 8 is a longitudinal sectional view corresponding to FIG. 2 in a second embodiment of the present invention.

As shown in FIG. 8, similarly to the impeller 10 of the above-described first embodiment, the impeller 210 of the second embodiment is an open type impeller which includes the disk part 30 and the blade part 40. The disk part 30 includes the disk main body part 35 and the cylindrical part 32.

The disk main body part 35 is formed in a disk shape which extends from the non-grip part 34 outward in the radial direction. The disk main body part 35 is formed so that the thickness gradually increases inward in the radial direction.

The disk part 30 includes the concave curved surface 31*a* which smoothly connects the front surface 31 and an outer peripheral surface 32*a* of the cylindrical part 32. The blade part 40 is formed so as to protrude from the front surface 31 of the disk part 30.

The above-described disk part 30 includes a cylindrical reinforcing member attachment part 250 which is positioned further rearward in the axis direction O direction than the disk main body part 35 and configures a portion of the cylindrical part 32.

The reinforcing member attachment part 250 includes an attachment part main body 54 and a ring member 55. The attachment part main body 54 is integrally formed with the cylindrical part 32.

The ring member 55 is formed so as to be separated from the cylindrical part 32. The ring member 55 is attached to the attachment part main body 54. The ring member 55 is formed of a material which forms the attachment part main body 54, that is, is formed of a material having the linear expansion coefficient equal to or greater than the linear expansion coefficient of the material which forms the cylindrical part 32. As the material which forms the ring member 55, for example, alloy such as stainless steel or titanium alloy, magnesium alloy, or the like may be used.

In the ring member 55, an accommodation groove part 55*a* forms on the outer peripheral surface of the ring member 55. The accommodation groove part 55*a* is annularly formed over the entire circumference of the outer peripheral surface of the ring member 55. The reinforcing member 53 is accommodated in the accommodation groove part 55*a*.

The reinforcing member 53 is formed similarly to the above-described first embodiment, and for example, is formed of CFRP in a cylindrical shape. As the material which forms the reinforcing member 53, a material having a higher specific strength than the attachment part main body 54 or the ring member 55, more specifically, a material having a higher specific strength and specific rigidity, is used. The reinforcing member 53 is attached to the ring member 55, and the ring member 55 is attached to the attachment part main body 54.

Next, a method for assembling the centrifugal compressor 100 including the impeller 210, and particularly, a procedure in which the impeller 210 is attached to the rotary shaft 5, will be described.

Figure 9:
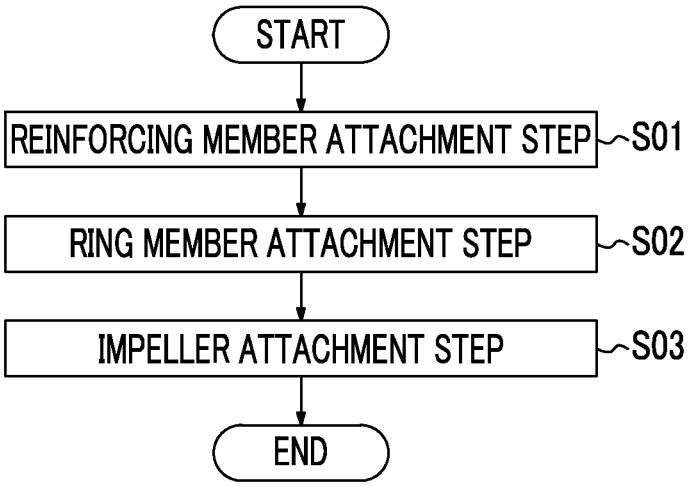
FIG. 9 is a flowchart showing an attachment procedure of an impeller of the second embodiment.

As shown in FIG. 9, first, a reinforcing member attachment step (Step S01) is performed, in which the reinforcing member 53 is attached to the ring member 55. Here, when the reinforcing member 53 is formed of CFRP, carbon fibers used for reinforcing materials are included so as to be directed toward the circumferential direction, and are wound around the ring member 55 in the state where a predetermined tension is applied to the carbon fibers.

Subsequently, a ring member attachment step (Step S02) is performed, in which the ring member 55 to which the reinforcing member 53 is attached to the attachment part main body 54. In this case, the ring member 55 is fixed to the attachment part main body 54 using freeze fitting, shrinkage fitting, or the like. Similarly to the first embodiment, in the case in which the reinforcing member 53 is formed of CFRP, when the shrinkage fitting is performed, the ring member 55 is attached to the attachment part main body 54 in the state where the ring member 55 is heated and CFRP is less than or equal to 100° C.

In addition, an impeller attachment step (Step S03) is performed in which the impeller 210 to which the ring member 55 is attached is fixed to the rotary shaft 5 using fitting such as freeze fitting or shrinkage fitting.

In the above-described second embodiment, the case where the reinforcing member 53 is accommodated in the accommodation groove part 55*a* of the ring member 55 is described as an example. However, the reinforcing member 53 is wound around the outer circumference of the ring member 55 by a predetermined tension without providing the accommodation groove part 55*a* on the ring member 55, and thus, the reinforcing member 53 may be attached to the ring member 55.

However, according to the impeller 210 of the above-described second embodiment, since the ring member 55 is formed of the material having the linear expansion coefficient equal to or greater than the linear expansion coefficient of the attachment part main body 54, when the ring member 55 is heated and removed from the attachment part main body 54, it is possible to remove the ring member 55 from the attachment part main body 54 in a state where a temperature difference between the attachment part main body 54 and the ring member 55 decreases.

As a result, it is possible to easily remove the reinforcing member 53 from the attachment part main body 54 while preventing the thermal load of the reinforcing member 53 generated by an increase of temperature.

In addition, since the ring member 55 is attached to the cylindrical part 32 after the reinforcing member 53 is attached to the ring member 55, it is possible to attach the reinforcing member 53 to the attachment part main body 54. Accordingly, it is possible to easily mount the reinforcing member 53 to the attachment part main body 54.

Next, an impeller 310 according to a third embodiment of the present invention will be described with reference to the drawings. In addition, a difference between the impeller 310 of the third embodiment and the impeller 210 of the above-described second embodiment is that the configurations of the grip parts 33 are different from each other. Therefore, the same reference numerals are assigned to the same portions as the above-described second embodiment, and the detailed descriptions are omitted.

Figure 10:
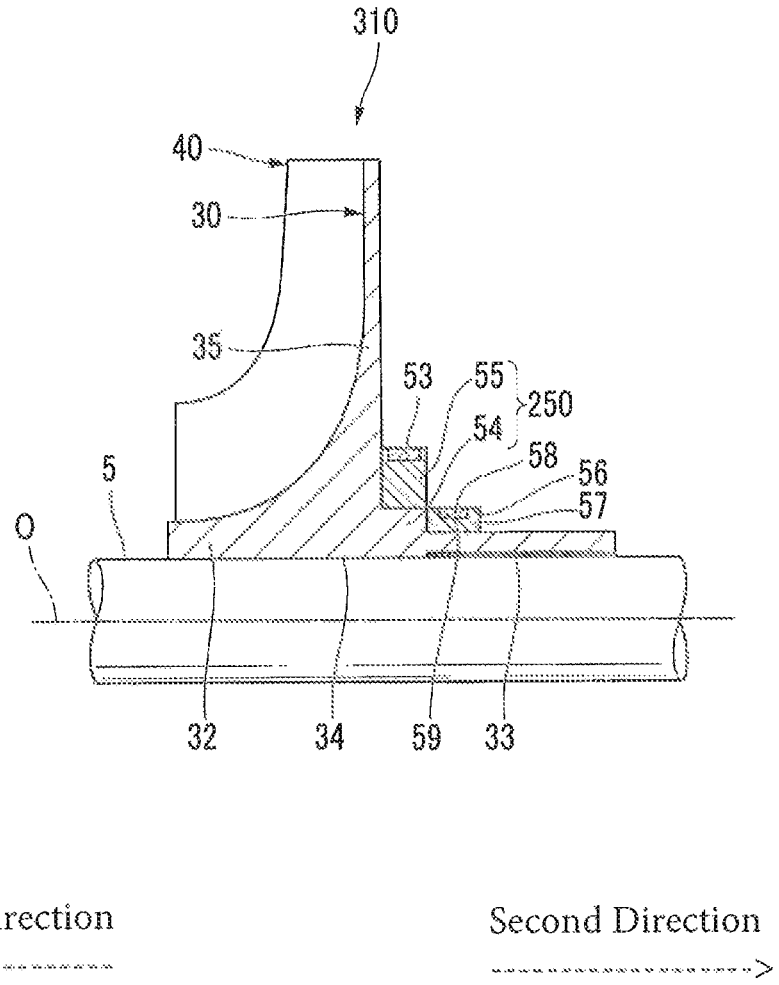
FIG. 10 is a longitudinal sectional view corresponding to FIG. 2 in a third embodiment of the present invention.

As shown in FIG. 10, similarly to the impeller 210 of the above-described second embodiment, the impeller 310 of the third embodiment is an open type impeller which includes the disk part 30 and the blade part 40. The disk part 30 includes the disk main body part 35 and the cylindrical part 32.

Similarly to the above-described second embodiment, the cylindrical part 32 includes the cylindrical reinforcing member attachment part 250 which is positioned further rearward in the axis direction O direction than the disk main body part 35 and configures a portion of the cylindrical part 32.

The reinforcing member attachment part 250 includes an attachment part main body 54 and a ring member 55. The reinforcing member 53 is attached to the reinforcing member attachment part 250 so as to be covered from the outside.

The cylindrical part 32 includes the grip part 33 which is fixed to the outer peripheral surface of the rotary shaft 5. The grip part 33 is disposed further rearward in the axis line O direction than the disk main body part 35. More specifically, the grip part 33 is disposed further rearward in the axis line O direction than the reinforcing member attachment part 50. The cylindrical part 32 includes the non-grip part 34 on the front side which is the side in the first direction in the axis line direction.

A grip pressing member 56 is attached to the cylindrical part 32. The grip pressing member 56 presses the grip part 33 from the outside in the radial direction, and reinforces the cylindrical part 32 in the grip part 33. The length in the axis line O direction of the grip pressing member 56 is formed so as to be sufficiently shorter than the length of the grip part 33. The grip pressing member 56 is attached at the position at which the grip part 33 of the cylindrical part 32 is disposed. More specifically, the grip pressing member 56 is attached at the position on the most front side of the grip part 33.

The grip pressing member 56 includes a grip ring member 57 and a grip reinforcing member 58. The grip ring member 57 is formed of the same material as the above-described ring member 55, and the inner diameter of the grip ring member 57 is formed so as to be slightly smaller than the outer diameter of the cylindrical part 32 at the attached location in the state where the grip ring member 57 is not attached to the cylindrical part 32. Moreover, similarly to the above-described accommodation groove part 55*a*, a ring-shaped accommodation groove part 59 is formed on the grip ring member 57. The cylindrical grip reinforcing member 58, which is formed of the material similar to that of the above-described reinforcing member 53, is accommodated in the accommodation groove part 59.

Figure 11:
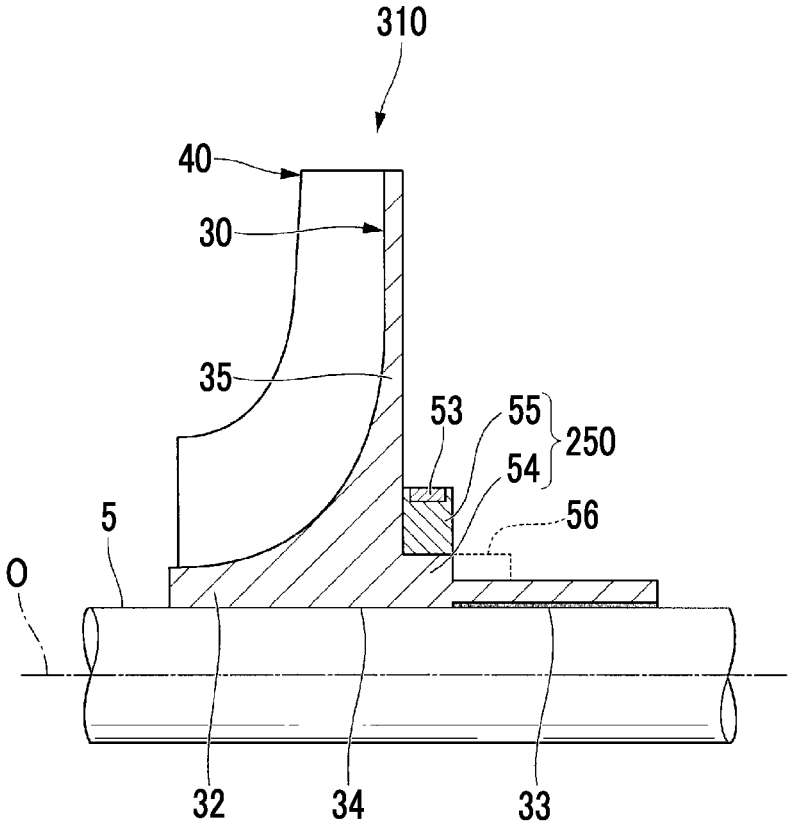
FIG. 11 is a longitudinal section view showing a state where a reinforcing member 53 is attached to an impeller of the third embodiment.

As shown in FIG. 11, after the above-described ring member 55 is attached to the attachment part main body 54, similarly to the above-described ring member 55, the grip pressing member 56 is attached to the cylindrical part 32 using freezing fitting or shrinkage fitting. In this embodiment, the case where the grip pressing member 56 includes the grip ring member 57 is described. However, the grip ring member 57 may be omitted, and thus, the grip reinforcing member 58 may be directly attached to the cylindrical part 32. In FIGS. 10 and 11, the inner diameter of the ring member 55 is the same as the outer diameter of the grip ring member 57. However, the thickness in the radial direction of the grip ring member 57 is not limited to the thickness shown in FIGS. 10 and 11, and is appropriately set according to the strength or rigidity of the cylindrical part 32. For example, when the outer diameter of the grip ring member 57 is smaller than the inner diameter of the ring member 55, the ring member 55 may be attached to the attachment part main body 54 after the grip ring member 57 is mounted on the cylindrical part 32.

Therefore, according to the impeller 310 of the above-described third embodiment, using the grip reinforcing member 58, it is possible to regulate deformation toward the outside in the radial direction of the grip part 33 generated due to the centrifugal force. Accordingly, it is possible to decrease the hoop stress applied to the cylindrical part 32 in the vicinity of the grip part 33, and it is possible to more strongly fix the impeller 310 to the rotary shaft 5.

The present invention is not limited to each configuration of the above-described embodiments, and the designs may be modified within a scope which does not depart from the gist.

For example, in each of the above-described embodiments, the open type impeller which includes only the disk part 30 and the blade part 40 is described as an example. However, the present invention is not limited to this case. The present invention may be similarly applied to a closed type impeller which includes a cover portion in addition to the disk part 30 and the blade part 40.

In addition, in each of the above-described embodiments, an example of the centrifugal compressor 100 is described as the rotating machine. However, for example, the impeller of the present invention may also be applied to various industrial compressors or turbo refrigerators, or a small gas turbine.

INDUSTRIAL APPLICABILITY

According to the present invention, an impeller can be easily attached to and detached from a rotary shaft, it is possible to sufficiently decrease hoop stress during rotation, and it is possible to rotate the impeller at a high speed.

Reference Signs List

5: ROTARY SHAFT
10: IMPELLER
30: DISK PART
31: FRONT SURFACE
31A: CURVED SURFACE
32: CYLINDRICAL PART
32a: OUTER PERIPHERAL SURFACE
33: GRIP PART
34: NON-GRIP PART
35: DISK MAIN BODY PART

-continued

| Reference Signs List |
|---|
| 40: BLADE PART |
| 40a: SURFACE |
| 50: REINFORCING MEMBER ATTACHMENT PART |
| 51: REAR SURFACE |
| 53: REINFORCING MEMBER |
| 54: ATTACHMENT PART MAIN BODY |
| 55: RING MEMBER |
| 55a: ACCOMMODATION GROOVE PART |
| 56: GRIP PRESSING MEMBER |
| 57: GRIP RING MEMBER |
| 58: GRIP REINFORCING MEMBER |
| 59: ACCOMMODATION GROOVE PART |
| 100: CENTRIFUGAL COMPRESSOR |
| 104: FLOW PATH |
| 105: CASING |
| 105a: JOURNAL BEARING |
| 105b: THRUST BEARING |
| 105c: SUCTION PORT |
| 105d: DISCHARGING PORT |
| 105e: WALL SURFACE |
| 210: IMPELLER |
| 250: REINFORCING MEMBER ATTACHMENT PART |
| 310: IMPELLER |
| 610: IMPELLER |
| 710: IMPELLER |
| a1: UPPER LIMIT |
| a2: UPPER LIMIT |
| D: DIAMETER |
| G: GAS |
| O: AXIS LINE |
| r1: OUTER DIAMETER |
| r2: DIAMETER |

The invention claimed is:

1. An impeller, comprising:

a disk part including: a cylindrical part into which a rotary shaft rotating around an axis line is inserted and which includes a grip part fixed to the rotary shaft at a portion of the cylindrical part in the axis line; and a disk main body part which extends from the cylindrical part outward in a radial direction of the rotary shaft, the axis line having a first direction and a second direction;

a blade which protrudes from the disk main body part toward the first direction;

a reinforcing member attachment part which is formed on the cylindrical part closer to the second direction than the disk main body part; and a reinforcing member which is formed of a material having a higher specific strength than the disk part, and is disposed outbound of the reinforcing member attachment part so as to surround the reinforcing member attachment part, wherein the reinforcing member attachment part includes:

an attachment part main body which is integrally formed with the cylindrical part; and a ring member which is formed of a material having a linear expansion coefficient equal to or greater than a linear expansion coefficient of the attachment part main body, and is attached to the attachment part main body, wherein the reinforcing member is attached to the ring member.

2. The impeller according to claim 1, wherein the grip part is disposed so as to be closer to the second direction than the reinforcing member, and a grip reinforcing member is disposed outbound of the grip part and reinforces the grip part.

3. The impeller according to claim 1, wherein a ratio of a diameter of the reinforcing member with respect to a diameter of the disk main body part is 0.35 to 0.8.

4. A rotating machine, comprising the impeller according to claim 1.

5. An impeller, comprising:

a disk part including: a cylindrical part into which a rotary shaft rotating around an axis line is inserted and which includes a grip part fixed to the rotary shaft at a portion of the cylindrical part in the axis line; and a disk main body part which extends from the cylindrical part outward in a radial direction of the rotary shaft, the axis line having a first direction and a second direction;

a blade which protrudes from the disk main body part toward the first direction;

a reinforcing member attachment part which is formed on the cylindrical part closer to the second direction than the disk main body part; and a reinforcing member which is formed of a material having a higher specific strength than the disk part, and is disposed outbound of the reinforcing member attachment part so as to surround the reinforcing member attachment part, wherein the grip part is disposed so as to be closer to the second direction than the reinforcing member, and a grip reinforcing member is disposed outbound of the grip part and reinforces the grip part.

6. A rotating, machine, comprising the impeller according to claim 5.

7. A method for assembling a rotating machine including an impeller comprising:

a disk part including: a cylindrical part into which a rotary shaft rotating around an axis line is inserted and which includes a grip part at a portion of the cylindrical part in the axis line;

and a disk main body part which extends from the cylindrical part outward in a radial direction of the rotary shaft, the axis line having a first direction and a second direction;

a blade which protrudes from the disk main body part toward the first direction; and a reinforcing member attachment part which is formed on the cylindrical part closer to the second direction than the disk main body part and which includes an attachment part main body integrally formed with the cylindrical part, the method comprising:

a reinforcing member attachment step of attaching a reinforcing member formed of a material having a higher specific strength than the disk part to a ring member formed of a material having a linear expansion coefficient equal to or greater than a linear expansion coefficient of the attachment part main body;

a ring member attachment step of attaching the ring member to the attachment part main body, wherein the ring member to which the reinforcing member is attached is disposed outbound of the reinforcing member attachment part so as to surround the reinforcing member attachment part; and an impeller attachment step of attaching the impeller to the rotary shaft, wherein the grip part is fixed to the rotary shaft.

* * * * *